US006255996B1

(12) United States Patent
Wallace

(10) Patent No.: US 6,255,996 B1
(45) Date of Patent: Jul. 3, 2001

(54) EFFICIENT ANTENNA SYSTEM FOR A PERSONAL COMMUNICATION DEVICE

(75) Inventor: Raymond C. Wallace, San Diego, CA (US)

(73) Assignee: Qualcomm Incorporated, San Diego, CA (US)

( * ) Notice: Subject to any disclaimer, the term of this patent is extended or adjusted under 35 U.S.C. 154(b) by 0 days.

(21) Appl. No.: 09/454,172

(22) Filed: Dec. 2, 1999

(51) Int. Cl.[7] ..... H01Q 1/24
(52) U.S. Cl. ..... 343/702; 343/895; 343/725
(58) Field of Search ..... 343/702, 895, 343/725, 729, 906, 901; H01Q 1/24

(56) References Cited

U.S. PATENT DOCUMENTS

D. 417,221 * 11/1999 Johnson et al. ..... 343/702
5,541,609 * 7/1996 Stuzman et al. ..... 343/702
5,905,966 5/1999 Yoshihara et al. ..... 455/575
6,028,556 * 2/2000 Shiraki ..... 343/702
6,107,966 * 8/2000 Fahlberg ..... 343/702

* cited by examiner

*Primary Examiner*—Hoanganh Le
(74) *Attorney, Agent, or Firm*—Philip Wadsworth; Charles D. Brown; Raymond B. Hom

(57) ABSTRACT

An antenna system is installed on a wireless device which is designed to be placed near the ear of a human user. The antenna system has a first antenna configured to transmit and receive signals. The first antenna is located at the end of a boom. The boom rotates so as to displace the first antenna away from the user's head when wireless device is in use in close proximity to the user's head. In one embodiment, the system includes a monopole whip antenna and a switching mechanism to alternatively activate the monopole whip antenna and the first antenna.

6 Claims, 6 Drawing Sheets

EFFICIENT ANTENNA SYSTEM FOR A PERSONAL COMMUNICATION DEVICE

BACKGROUND OF THE INVENTION

1. Field of the Invention

The invention pertains to wireless communication devices. More particularly, the invention relates to antenna systems used with such devices.

2. Description of the Related Art

Wireless communication devices are becoming increasingly prevalent, with cellular telephones being a particularly notable example. With these devices, radio-frequency (RF) signals are transmitted and received to create a communication link to the device.

Most wireless communication devices contain one or more antennas protruding from a surface of the device to facilitate transmission and reception of the RF signals. Therefore, the upper surface of the device is usually the most efficient location for an antenna because this location provides the antenna the clearest path to and from the device. This antenna location also allows for some form of extendable whip antenna to be extended without interfering with the user's operation of the device. Numerous antenna systems exist which contain one or more antennas located on the upper surface of a wireless communication device.

Referring now to FIGS. 1A–1C, one type of prior art wireless communication device 90 is illustrated. FIG. 1A illustrates a frontal elevation view of a wireless communication device 90. FIG. 1B illustrates a side elevation view of the wireless communication device. FIG. 1C illustrates a top elevation view of the wireless communication device 90. The device 90 may be, for example, a cellular telephone, or other wireless communication product. The device 90 shown in FIGS. 1A–1C contains both a monopole whip antenna 92 and a helical antenna 94. The monopole whip antenna 92 extends through the center of the helical antenna 94. When the monopole whip antenna 92 is extended, the helical antenna 94 is disengaged from the transceiver and the monopole whip antenna 92 is used to transmit and receive RF signals. When the monopole whip antenna 90 is less than fully extended, the helical antenna 94 is engaged with the transceiver and the helical antenna 94 is used to transmit and receive RF signals.

Typically, the wireless communication device 90 exchanges wireless link signals with a base station. As the signals travel between the wireless communication device 90 and the base station, the signal energy of the RF signal dissipates exponentially as a function of the distance that the signal travels. In addition, the RF signals also dissipate when they pass through or reflect off of objects such as buildings, people or cars. In addition, when the helical antenna 94 is used, considerable signal loss can occur if the user's head disrupts the wireless link path between the wireless communication device 90 and the base station. When the monopole whip antenna 92 is extended, it extends up past the head of the user. However, the helical antenna 94, by nature of its small design, is more susceptible to path loss due to the user's head. For this reason, generally, the wireless communication device 90 performs better when the monopole whip antenna 92 is engaged.

Many standard wireless devices are sold today with the antenna configuration shown in FIG. 1. This configuration allows the user to operate the device with the monopole whip antenna 92 less than fully extended for the convenience of the user. For example, extending the antenna can require additional motion from the user who may wish to answer a ringing phone quickly. In addition, in certain operating conditions, such as in a crowded area or confined automobile, it is impractical to fully extend the monopole whip antenna 92. In these instances, it is common for the user to operate the wireless communication device 90 with the monopole whip antenna 92 less than fully extended.

The increase in path loss means that either the performance of the system is adversely impacted or that the transmitted signal power must be increased. Adverse changes in performance are often intolerable to system operation and can result in system failure. Increasing the transmitted signal power can result in reduced battery life, large heat dissipation problems and difficulty in meeting government signal level limit requirements. For this reasons, some systems are designed such that the user is unable to use of the helical antenna 94 to establish communication in some limited regions of the system.

It will be appreciated that there is a need in the technology for a means and method that minimizes the loss resulting from signals being forced to pass through the user's head in these circumstances.

SUMMARY OF THE INVENTION

The invention is a novel and improved antenna system for wireless communication devices. According to the invention, a helical antenna or other low profile antenna is located at the end of a boom. The boom protrudes laterally away from the device increasing the distance between the user's head and the helical antenna. In one embodiment, the system also contains a retractable monopole whip antenna located on the top of the wireless communication device. In another embodiment, the boom can rotate 90 degrees to be located over the upper surface of the wireless communication device for easy storage when the device is not in use. In yet another embodiment, the boom telescopically extends away from the wireless communication device.

This system improves the transmission efficiency of the wireless communication device when the whip antenna is retracted and the helical antenna is used to transmit RF signals or when the device only contains a helical antenna. Therefore, by moving the helical antenna a short distance away from the user's head, the system improves signal quality by minimizing loss near the antenna.

BRIEF DESCRIPTION OF THE DRAWINGS

The features, objectives, and advantages of the invention will become more apparent from the detailed description set forth below when taken in conjunction with the drawings wherein like elements are identified with like numerals throughout.

DETAILED DESCRIPTION OF THE INVENTION

Figure 1A:
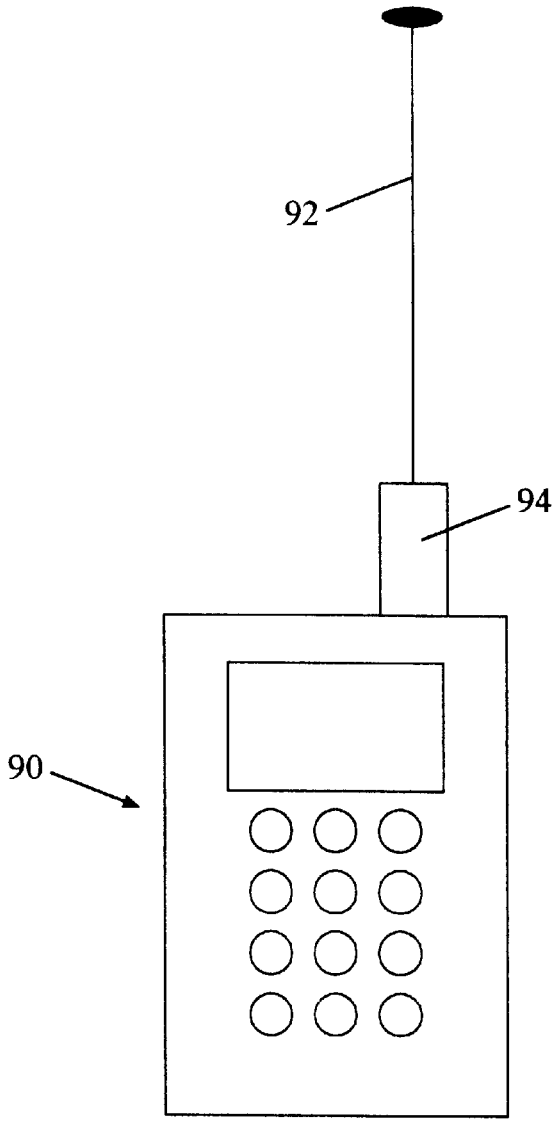
FIG. 1A (PRIOR ART)
FIG. 1A is a front elevation view of a wireless communication device with an antenna system containing both a monopole whip antenna and a helical antenna.
Figure 1B:
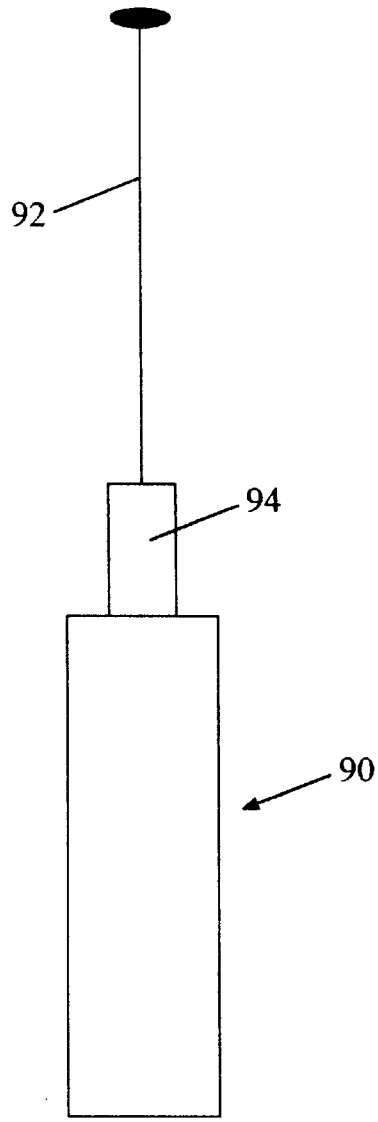
FIG. 1B (PRIOR ART)
FIG. 1B is a side elevation view of the wireless communication device of FIG. 1A.
Figure 1C:
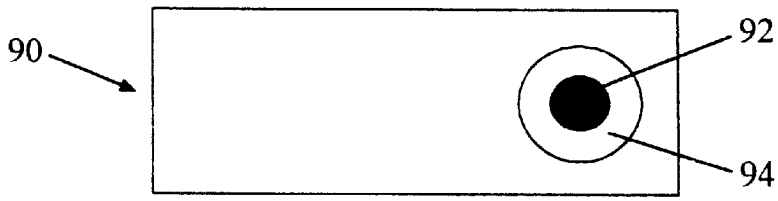
FIG. 1C (PRIOR ART)
FIG. 1C is a top plan view of the wireless communication device of FIG. 1A.
Figure 2A:
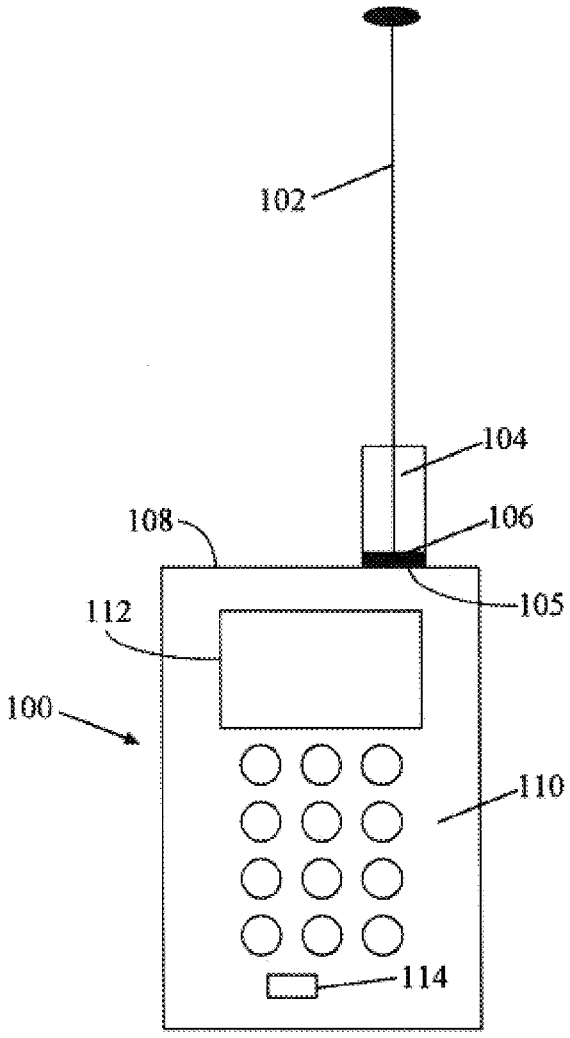
FIG. 2A is a front elevation view of a wireless communication device with an antenna system utilizing the invention.
Figure 2B:
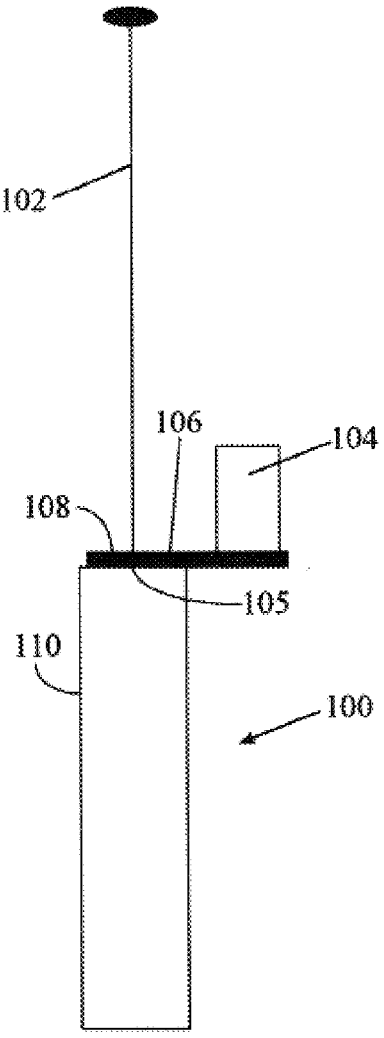
FIG. 2B is a side elevation view of the wireless communication device of FIG. 2A.
Figure 2C:
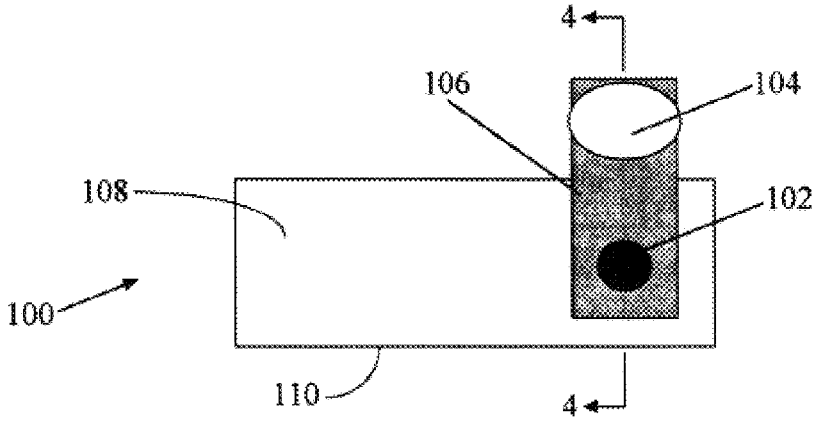
FIG. 2C is a top plan view of the wireless communication device of FIG. 2A.

FIGS. 2A–2C illustrate one embodiment of the invention. FIG. 2A is a front elevation view of a personal wireless communication device 100 with an antenna system according to one embodiment of the invention. This embodiment comprises a monopole whip antenna 102, a helical antenna 104 and a boom 106. The monopole whip antenna 102 extends perpendicularly from a top surface 108 of the wireless communication device 100. The boom 106 is coupled to the top surface 108 of the wireless communication device 100 and, in one embodiment, is coupled to a standard swivel mechanism 105 which is configured to rotate the boom 106 around a pivot axis at the centerline of the monopole whip antenna 102. In an alternative embodiment, the boom 106 has a fixed position and is not configured to rotate. In yet another embodiment, the boom telescopically extends away from the wireless communication device. As shown in FIG. 2A, in one stop position, the rotating boom 106 extends laterally away from a front surface 110 of the main body of the wireless communication device 100. In one embodiment, the front surface 110 of the main body of the wireless communication device 100 comprises an ear piece 112 and mouth piece 114 and is intended to be placed against the ear of the human user.

FIG. 2B is a side elevation view of the wireless communication device 100 more clearly showing the boom 106 extended laterally away from the front surface 110 of the device 100. In the embodiment shown, the monopole whip antenna 102 travels through the boom's axis of rotation. As such, the rotation of the boom 106 does not affect the location of the monopole whip antenna 102. The helical antenna 104 extends along the length of the boom 106 and at the tip of the boom 106 comprises a helical radiating portion 140 (shown explicitly in FIG. 4). The helical radiating portion 140 extends in a direction that is perpendicular to the boom 106 and away from a top surface 108 of the wireless communication device 100. The helical antenna 104 is located on the boom 106 to increase the distance between the helical radiating portion 140 and the user's head. In alternative embodiments, another type of low profile antenna can be used in place of the helical antenna.

FIG. 2C is a top plan view of the wireless communication device 100 showing the boom 106 extended laterally away from the front surface 110 of the device 100. From FIG. 2C, the relative location of the monopole whip antenna 102 and the helical antenna 104 is clearly shown. In one embodiment, the user of the device 100 can manually rotate the boom 106 ninety (90) degrees counter-clockwise such that the boom 106 extends over the top surface 108 parallel to the front surface 110 for easy storage. In one embodiment, the boom 106 is also capable of rotating more than ninety degrees, such as 180 degrees or more. In yet another embodiment, the boom 106 can rotate 360 degrees in either a clockwise or counter-clockwise direction.

The monopole whip antenna 102 and the helical antenna 104 are mechanically coupled so that at any given time, only one of them is in electrical contact with the RF components within the wireless communication device 100 in any position. When it is fully extended, only the monopole whip antenna 102 is in electrical contact with the RF components within the wireless communication device 100. When the monopole whip antenna 102 is less than fully extended, it is electrically disconnected from the RF components within the wireless communication device 100 and the helical antenna 104 is in electrical contact with the RF components within the wireless communication device 100. The rotation of the boom 106 does not affect connection of either the monopole whip antenna 102 or the helical antenna 104 to the RF components within the wireless communication device 100. The preferred position of the boom 106 during operation is the extended configuration shown in FIGS. 2A–2C, although the device 100 can be configured to operate in any boom position. Alternatively, the device 100 can be disabled when the monopole whip antenna 102 is less than fully extended and the boom 106 is in the storage position. The details of the switching mechanism used in this embodiment are described in more detail with reference to FIG. 4.

The present invention solves the need in the industry for an antenna system that minimizes the loss resulting from signals being forced to pass through the user's head. This problem is solved by placement the helical antenna 104 on the boom 106 that laterally protrudes away from the wireless communication device 100, thereby increasing the distance between the user's head and the helical antenna 104 and reducing the loss experienced by the signal. In addition, in one embodiment, the ability to move the location of the helical antenna 104 by rotation of the boom more than 90 degrees also allows the user to position the helical antenna 104 to adjust for current operating conditions.

Figure 3A:
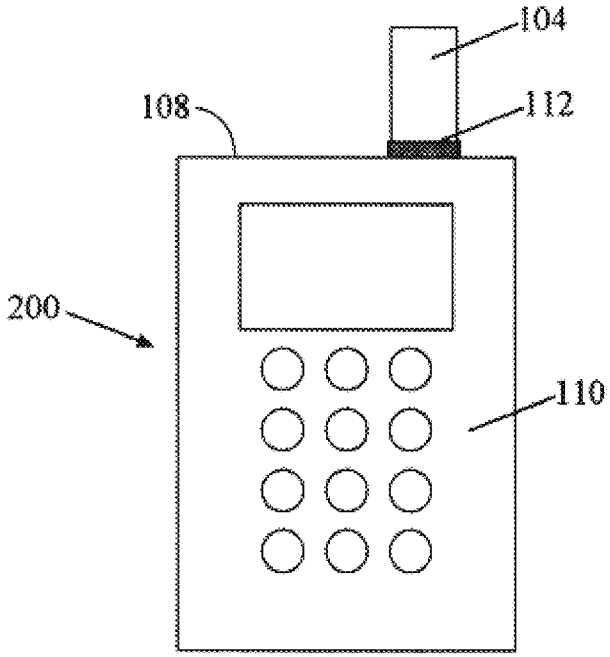
FIG. 3A is a front elevation view of a wireless communication device with an antenna system utilizing an alternative embodiment of the invention.
Figure 3B:
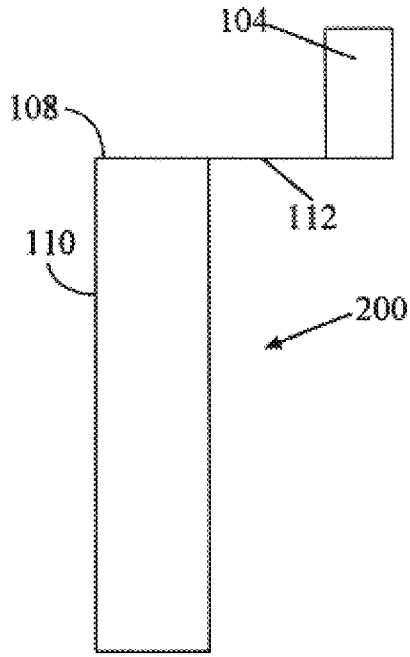
FIG. 3B is a side elevation view of the wireless communication device of FIG. 3A.
Figure 3C:
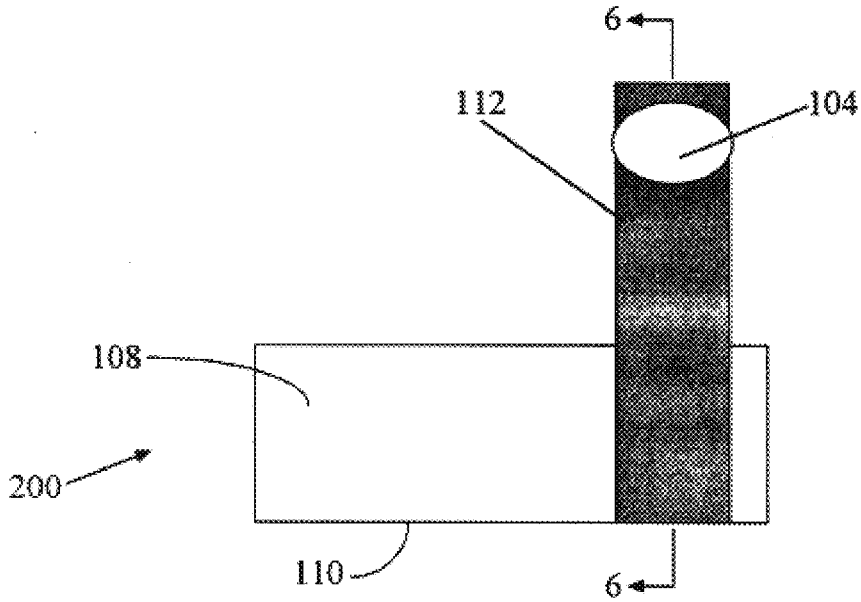
FIG. 3C is a top plan view of the wireless communication device of FIG. 3A.

FIGS. 3A–3C illustrate another embodiment of the invention that does not include a monopole whip antenna. In this embodiment, when a user activates a wireless communication device 200, the helical antenna 104 is utilized for all transmissions.

In FIGS. 3A–3C, a boom 112 is shown to have the same general configuration as the boom 106 in FIGS. 2A–2C except that its length has been increased so as to increase the distance between the user's head and the helical radiating portion 140 of the helical antenna 104, and no provision has been made for the inclusion of a monopole whip antenna. As distance between the user's head and the helical radiating portion 140 of the helical antenna 104 is increased, the path loss attributable to the user's head decreases on average. Thus, increasing length of the boom 112 increases the performance of the wireless communication device 100. In one embodiment, the length of the boom 112 is limited by the length of the top surface 108 of the wireless communication device 100 so that the boom 112 does not extend past the edge of the top surface 108 of the device 200 when the boom 112 is in the storage position.

Figure 4:
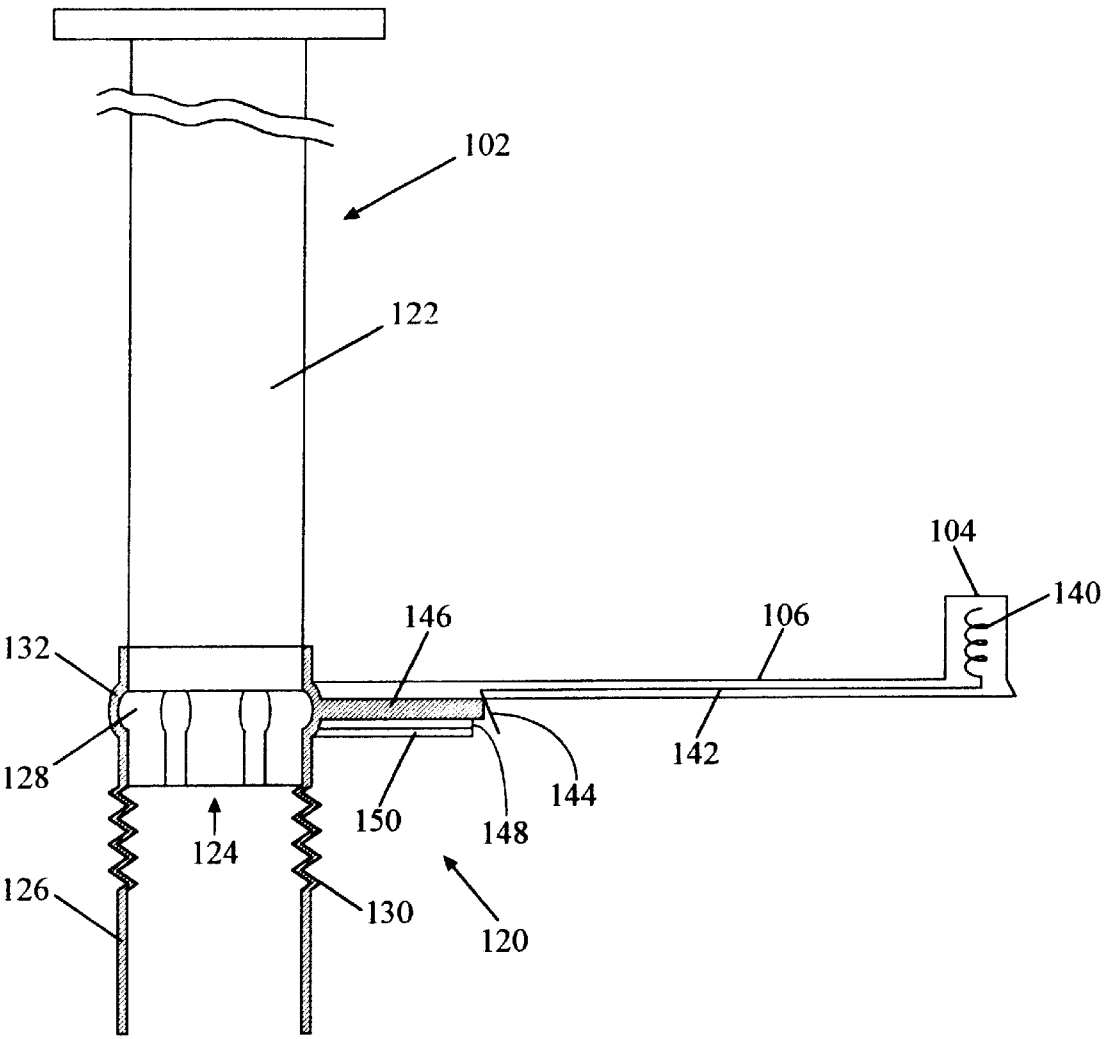
FIG. 4 is a cross-sectional view of the switching mechanism used in the invention taken along line 4—4 of FIG. 2C.

FIG. 4 illustrates a cross-sectional view taken along line 4—4 of FIG. 2C showing more clearly a switching mechanism 120 which controls the antenna coupling. The monopole whip antenna 102 is shown to comprise a radiating portion 122, a shaft portion 126 and a stopper 124. The radiating portion 122 has an elongated rod shape and is typically encapsulated in a mechanically protective polymer material. The encapsulating material also acts to conductively isolate the radiating portion 122 from the shaft portion 126 when the monopole whip antenna 102 is less than fully extended. In one embodiment, the radiating portion 122 comprises a helical or other configuration which functions to minimize its physical length while retaining suitable radiating properties. The shaft portion 126 defines a channel which extends longitudinally through the interior of the shaft portion 126 and through which the radiating portion 122 is slidably mounted. The length of the shaft portion 126 is less than the length of the monopole whip antenna 102. Accordingly, a storage channel (not shown) extends downward past the end of the shaft portion 126 within the device housing. Thus, when the monopole whip antenna 102 is disposed in the fully retracted position, its lower portion lie within at least a portion of the storage channel.

The stopper 124 is located at the lower end of the radiating portion 122 and is electrically coupled thereto. The stopper 124 is formed from conductive fingered material. A distended portion 128 of the stopper 124 has a slightly larger diameter than the radiating portion 122. When the monopole whip antenna 102 is fully extended, the distended portion 128 of the stopper 124 becomes electrically coupled to an antenna connector 130 via a contact protrusion 132 on the interior surface of the top portion of the shaft 126. For example, in one embodiment, the shaft portion 126 is constructed of conductive material. The interior diameter of the contact protrusion 132 is slightly smaller than the exterior diameter of the distended portion 128. The fingered material of the stopper 124 compresses inward when disposed within the shaft portion 126. When the monopole whip antenna 102 is fully extended, the distended portion 128 is seated within the contact protrusion 132 so as to mechanically secure the monopole whip antenna 102 in place and so as to provide a reliable electrical connection between the shaft portion 126 and the monopole whip antenna 102.

Figure 5:
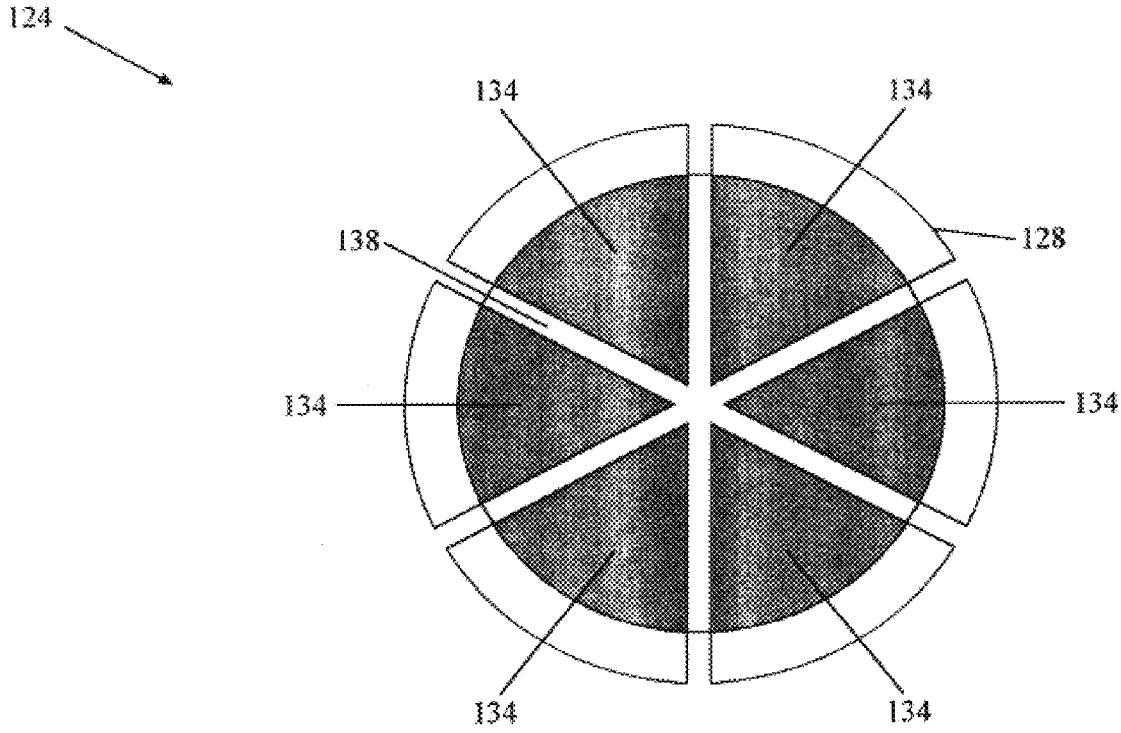
FIG. 5 is a bottom plan view of the stopper of the monopole whip antenna.

FIG. 5 is a bottom plan view of the stopper 124 showing the fingered nature of its construction. From this view, a set of fingers 134 are apparent. In one embodiment, the set of fingers 134 is constructed of beryllium copper or other conductive material capable of flexing without breaking. Each finger of the set of fingers 134 is connected to a common mounting area (not shown) at the top of the stopper 124. The fingers 134 extend downward from the mounting area parallel to one another longitudinally along the length of the stopper 124 defining gaps 138 between the fingers 134. Each of the set of fingers 134 is spring-like and thus, can move inward toward one another in response to an application of force. When the stopper 124 is disposed within the shaft portion 126, the set of fingers 134 deforms and moves inward toward one another decreasing the side of the gaps 138 due to the pressure exerted on the distended portion 128. When the distended portion 128 is fully seated in the contact protrusion 132, the set of fingers 134 remains under inward pressure from the contact protrusion 132 and deforms inward causing a reliable mechanical and electrical connection between the contact protrusion 132 and the distended portion 128.

Referring again to FIG. 4, in one embodiment, the antenna connector 130 includes a threaded portion on the outside surface of the shaft 126. When installed in device 100, the antenna connector 130 is threadably coupled to the top surface 108 of the wireless communication device 100. When installed, the antenna connector 130 is also electrically coupled to the RF components within the wireless communication device 100 and, thereby, provides the coupling between the switching mechanism 120 and the RF components. For example, in one embodiment, the antenna connector 130 is coupled to a threaded conductive receptacle when installed on the wireless communication device 100 and the threaded conductive receptacle is coupled to the RF components within the wireless communication device 100.

In general, the helical antenna 104 is made up of the helical radiating portion 140 having a spiral or helical shape and a boom conductor 142 which, in one embodiment, is also configured to radiate and receive signal energy. In one embodiment, the radiating portion 140 is encapsulated in a mechanically protective polymer material. The conductive radiating portion 140 may comprise another configuration which functions to reduce its physical length while retaining suitable radiating properties such as a meandering line antenna, a ceramic or dielectrically loaded antenna or a patch antenna.

The switching mechanism 120 (FIG. 4) is used to activate either the monopole whip antenna 102 or the helical antenna 104. The monopole whip antenna 102 is activated in "whip mode" when the monopole whip antenna 102 is fully extended as shown in FIG. 4. In "whip mode", the stopper 124 physically displaces a dielectric plate 146 away from the monopole whip antenna 102. In the illustrated embodiment, the dielectric plate 146 is slidably disposed between the boom 106 and a conductive portion 150. The conductive portion 150 is disposed on an opposite side of the dielectric plate 146 from the boom 106 and is slidably coupled with the dielectric plate 146. The conductive portion 150 is electrically coupled to the shaft portion 126 and the antenna connector 130. The conductive portion 150 is mechanically coupled at one end to the boom 106 such that it remains in the same relative position with respect to the boom 106 as the boom 106 rotates. For example, in one embodiment, the conductive portion 150 is mechanically coupled to the boom 106 by a protective casing that encases the boom 106 and the conductive portion 150. The conductive portion 150 is slidably coupled to the shaft portion 126 such that the conductive portion 150 is free to rotate with the boom 106. In another embodiment, the dielectric plate 146 may be comprised of a material other than a dielectric.

When displaced by the stopper 124, the dielectric plate 146 presses upon a boom contact 144. In one embodiment, the boom contact 144 is a straight spring mechanically coupled to the boom 106 and electrically coupled to the boom conductor 142. The boom contact 144 is biased toward the shaft portion 126 against the dielectric plate 146. The boom contact 144 bends under the pressure of the displaced dielectric plate 146 and physically and electrically separates from an antenna connector contact 148. In one embodiment, the antenna connector contact 148 is a simple conductive pad disposed at the distal end of the conductive portion 150 so as to couple with the boom contact 144 when the dielectric plate 146 is not displaced by the stopper 124. When the dielectric plate 146 is displaced, a physical separation electrically disconnects the helical antenna 104 from electrical coupling with the antenna connector 130 via the conductive portion 150 and, hence, disconnects the helical antenna 104 from electrically coupling with the RF components within the wireless communication device 100. Therefore, in "whip mode" the monopole whip antenna 102 is activated and the helical antenna 104 is dormant.

When the monopole whip antenna 102 is less than fully extended, the stopper 124 does not displace the dielectric plate 146 nor make electrical contact with the contact protrusion 132. The biased boom contact 144 presses against the dielectric plate 146 and the dielectric plate 146 slides toward the shaft portion 126 into its natural position. In this embodiment, the boom contact 144 contacts the antenna connector contact 148. In this "helical mode", the helical antenna 104 is activated.

Like most common antenna designs, the configuration of FIG. 4 is not properly activated in either whip mode or helical mode when the stopper 124 is partially disposed within the shaft portion 126 but is not fully seated in the contact protrusion 132. Common operating instructions caution the user from operating the device with the monopole whip antenna in the less than the fully extended or less than fully retracted states.

Figure 6:
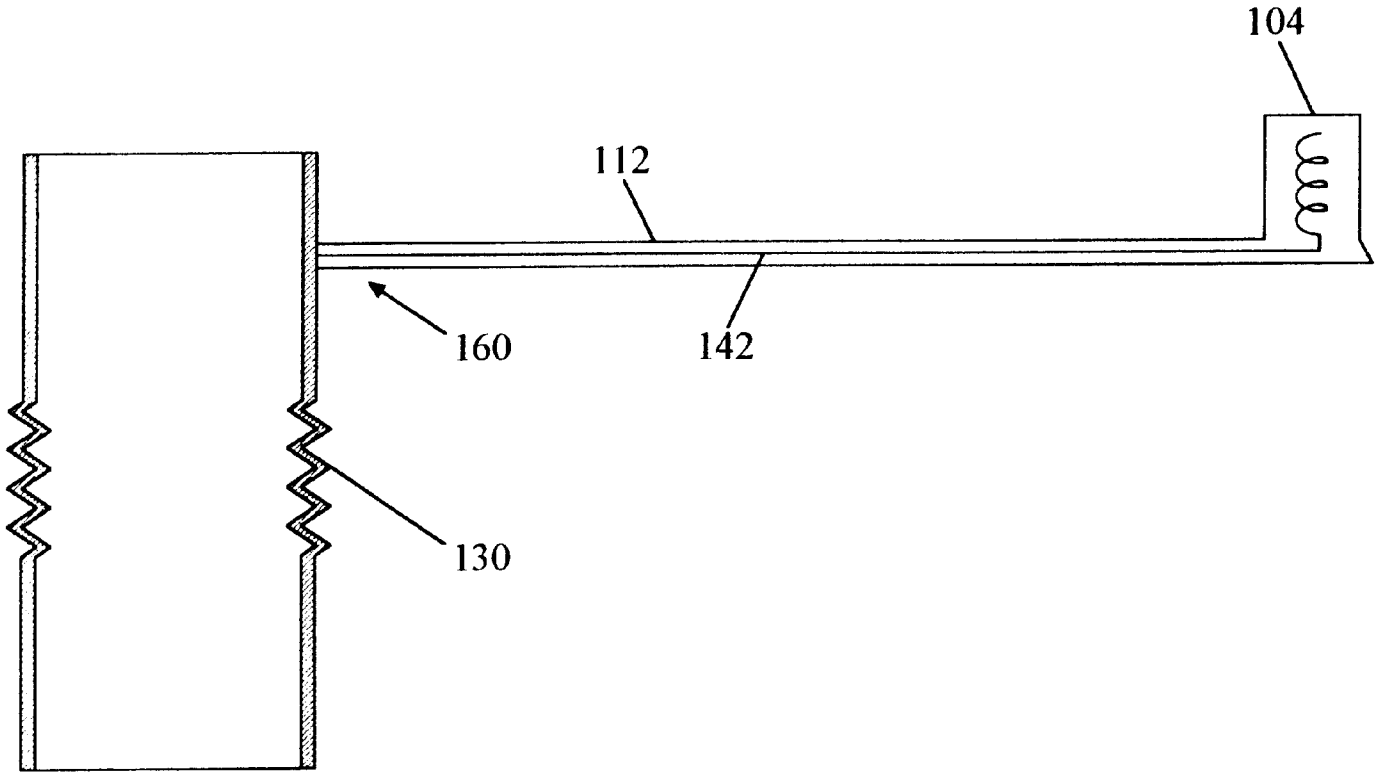
FIG. 6 is a cross-sectional view of an alternative embodiment of the invention of the switchless antenna configuration, taken along line 6—6 of FIG. 3C.

FIG. 6 is a cross-sectional view of an alternative embodiment of the invention, taken along line 6—6 of FIG. 3C. The embodiment of FIG. 6 does not contain a monopole whip antenna. The embodiment of FIG. 6 comprises the helical antenna 104 and an electrical connection mechanism 160. The helical antenna 104 is located on the boom 112. The electrical connection mechanism 160 comprises the conductor 142 and the antenna connector 130. This embodiment does not contain a switching device because there is only one antenna and, therefore, no need to switch between multiple antennas. In one embodiment, the helical antenna 104 is always coupled to the antenna connector 130.

The invention improves the transmission efficiency of the personal wireless communication device when the low profile antenna is used to transmit RF signals. By moving the low profile antenna away from the user's head, the system improves system operation by minimizing the average path loss due to the user's head.

One common design used for personal communications is the "clam shell" design. In a clam shell device, the housing is constructed of two portions coupled together by a hinge. In the closed position, the two portions fold together such that an inner surface of both portions is placed in close proximity to one another and the profile of the device is reduced. In the open position, the inner surfaces of the two portions rotate apart from one another. Typically, the ear piece in a clam shell device is located on the upper inner surface of device. In such design, a whip antenna can be attached to the hinge area of the device such as shown in U.S. Pat. No. 5,905,966 entitled PORTABLE RADIO APPARATUS CAPABLE OF KEEPING THE ANTENNA WAY FROM USER WHEN CALLING. According to the present invention, a boom and low profile antenna as described above can be connected to the hinge area of the device.

Many alternate embodiments of the invention will be readily apparent to one of skill in the art. For example, other switching mechanism differing from the one shown may be incorporated into the invention.

The invention may be embodied in other specific forms without departing from its spirit or essential characteristics. The described embodiments are to be considered in all respects only as illustrative and not restrictive and the scope of the invention is, therefore, indicated by the appended claims rather than by the foregoing description. All changes which come within the meaning of equivalency of the claims are to be embraced within their scope.

What is claimed is:

1. An antenna system in a wireless device having a main body with a front surface, the antenna system comprising:

a first antenna configured to transmit and receive signals;

a boom on which the first antenna is mounted; and a swivel mechanism coupled to the boom and configured to rotate the boom about a pivot axis extending above a top surface of the main body of the wireless device, wherein the boom is configured to displace the first antenna away from the front surface of the wireless device and the transmit and receive signals are coupled, respectively, to and from the first antenna through the boom.

2. The antenna system of claim 1, wherein the first antenna is a helical antenna, wherein a portion of the helical antenna extends along a length of the boom.

3. The antenna system of claim 2, further comprising:

a second antenna configured to transmit and receive signals, the second antenna being extendable along an axis which is coincident with the pivot axis, and a switching mechanism that selectively couples the first antenna or the second antenna to RF signal circuitry within the wireless device.

4. The antenna system of claim 3, wherein the second antenna is a monopole whip antenna.

5. An antenna system for use in a personal wireless device having a main body with a top surface, the antenna system comprising:

an antenna connector configured to be electrically coupled to an electronic circuit;

a retractable monopole whip antenna comprising:

a radiating portion retractably mounted to the top surface of the main body of the personal wireless device, a stopper located at a lower end of the radiating portion within the personal wireless device, the stopper having a slightly larger diameter than the radiating portion;

a switch having a slidable dielectric plate configured to be displaced by the stopper when the retractable monopole whip antenna is in a fully extended position;

a helical antenna electrically coupled to the switch; and a boom on which a helical radiating portion of the helical antenna is mounted such that a length of the boom separates the retractable monopole whip antenna and the helical radiating portion, wherein the switch is configured to couple the retractable monopole whip antenna to the antenna connector when the retractable monopole whip antenna is fully extended and is configured to couple the helical antenna to the antenna connector when the retractable monopole whip antenna is not fully extended.

6. The antenna system of claim 5 wherein the boom is configured to rotate about a pivot axis at a centerline of the retractable monopole whip antenna.

* * * * *